United States Patent [19]

Roberts

[11] 4,178,135

[45] Dec. 11, 1979

[54] VARIABLE CAPACITY COMPRESSOR

[75] Inventor: Richard W. Roberts, Lombard, Ill.

[73] Assignee: Borg-Warner Corporation, Chicago, Ill.

[21] Appl. No.: 861,386

[22] Filed: Dec. 16, 1977

[51] Int. Cl.[2] ..... F04B 1/14

[52] U.S. Cl. ..... 417/222; 417/269

[58] Field of Search ..... 417/222, 269, 220; 74/60

[56] References Cited

U.S. PATENT DOCUMENTS

| | | | |
|---|---|---|---|
| 2,711,135 | 6/1955 | Dunlap | 417/222 |
| 2,964,234 | 12/1960 | Loomis | 74/60 |
| 3,861,829 | 1/1975 | Roberts et al. | 417/270 |

*Primary Examiner*—William L. Freeh

*Attorney, Agent, or Firm*—Thomas B. Hunter

[57] ABSTRACT

A controlled, variable displacement swash plate compressor is provided with means for controlling the capacity pivoting the swash plate about the drive shaft axis to vary the effective pumping capacity. The position of the swash plate with respect to the drive shaft axis is a function of the pressure maintained inside the crankcase, said position being a result of the various forces acting on the pistons, including the underside of the pistons where crankcase pressure is applied. A cam surface is provided to maintain a fixed top dead center position at all displacements, as well as an improved universal joint mechanism to anchor the swash plate against rotation.

6 Claims, 4 Drawing Figures

VARIABLE CAPACITY COMPRESSOR

BACKGROUND OF THE INVENTION

1. Field of the Invention

A rotary wobble plate or swash plate compressor of the type in which the swash plate is pivoted about the drive shaft axis to vary the length of stroke.

2. Description of the Prior Art

In U.S. Pat. No. 3,861,829 issued to Roberts et al on Jan. 21, 1975, there is described a compressor in which crankcase pressure is controlled to vary the inclination of the swash plate relative to the drive shaft axis. In the Roberts et al patent, the swash plate is pivoted at a point spaced from the axis so that there is substantially zero clearance volume at the minimum capacity position.

SUMMARY OF THE INVENTION

The present invention relates to a controlled variable capacity swash plate compressor which incorporates certain features of the aforementioned Roberts et al patent, but is greatly simplified with respect to the construction of the compressor and the control mechanism therefor. In the Roberts et al compressor, the swash plate is pivoted so that it can move from a position normal to the drive line axis (the no-stroke position) to another position in which the wobble plate is inclined at a substantial angle to the normal plane (the full-stroke postion). Control of the Roberts et al compressor is achieved by varying the pressure within the crankcase, which pressure would normally build up as the result of vapor bypassing the pistons. The position of the swash plate is determined by the resultant of all forces acting thereon. One set of forces is generated by crankcase pressure acting on the underside of each piston; so that by simply varying the crankcase pressure, any intermediate position of the swash plate between the full-stroke and the no-stroke positions can be accomplished.

In the present invention, the swash plate is carried on a rotatable drive plate which in turn is supported on a slidable pin extending through the drive shaft. The pin moves to and fro in a slot to permit the entire swash plate and drive plate assemblies to move toward and away from the cylinder block thus varying the stroke length. The drive plate has a cam follower which cooperates with a cam surface to ensure that there is a fixed top dead center position at all displacements.

DETAILED DESCRIPTION OF THE INVENTION

Figure 1:
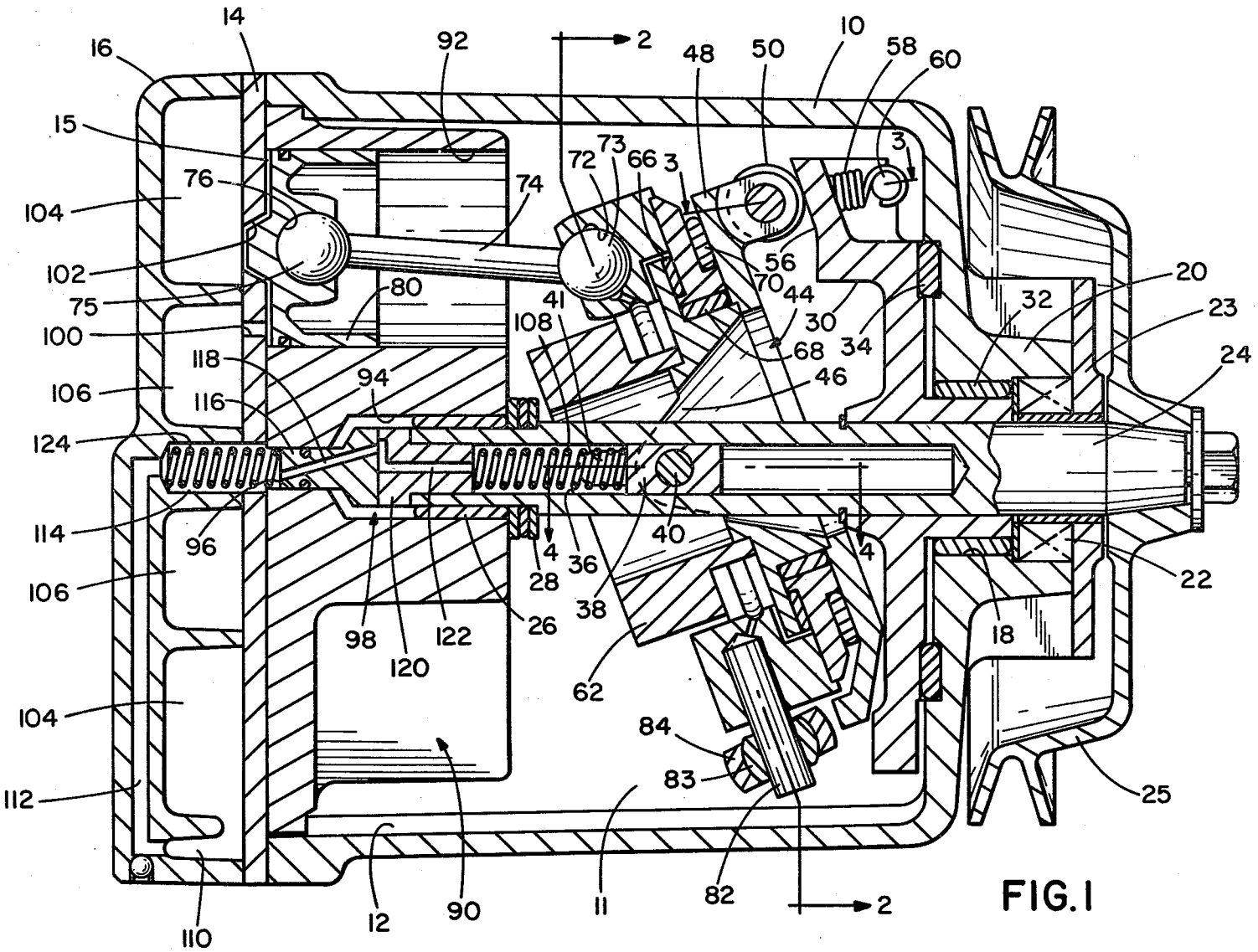
FIG. 1 is a cross-section view of a swash plate compressor constructed in accordance with the principles of this invention.
Figure 2:
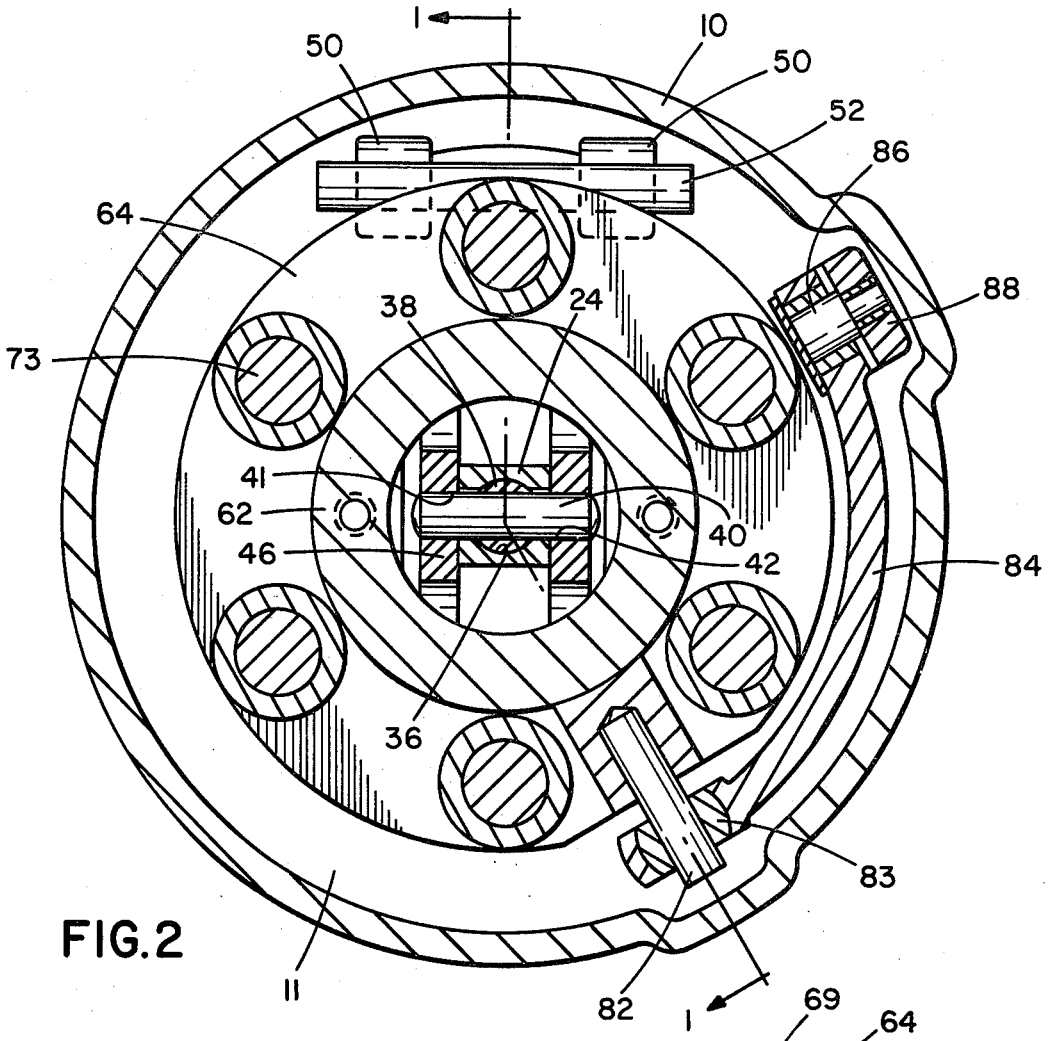
FIG. 2 is a cross-section view of the compressor taken along the plane of line 2—2 of FIG. 1.

Referring first to FIG. 1, there is shown a compressor having a housing or casing 10 which is generally bell shaped and has a large open end at 12 which is closed (except for oil distribution passages to be described below) by a valve plate assembly 14 and a head member 16. The opposite end of the compressor (at the right-hand side of FIG. 1) has a bore 18 extending there-through and an axially extending boss 20 to provide a space for seal assembly 22 and to which seal plate 23 is secured. Housing 10 thus encloses a sealed volume which will be referred to as the crankcase 11.

A drive shaft 24 extends through the seal plate 23 and is adapted to be fitted with a drive means such as a pulley 25 or a direct drive device (not shown). In an automotive application, the compressor would normally be driven by a V-belt from one of the accessory drive pulleys inside the engine compartment. However, in certain applications a direct drive is desired, with or without a clutch member.

Drive shaft 24 is journalled at its left-hand end (as viewed in FIG. 1) in a radial bearing 26 and thrust bearing 28. At the right-hand end of shaft 24 there is secured a reaction plate 30 which rotates with the shaft and is journalled in radial bearing 32 and engages thrust bearing 34.

Figure 3:
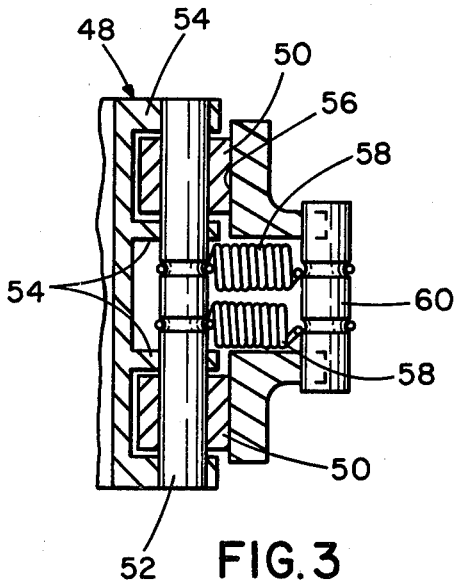
FIG. 3 is a partial cross-section view taken along the plane of line 3—3 of FIG. 1.

Throughout a substantial portion of its length, drive shaft 24 has an axially extending bore 36 drilled therein. Received within bore 36 is a cylindrical slider 38 through which extends a cross pin 40. The opposite ends of cross pin 40 protrude out through a pair of slots 41, 42 formed in opposite side walls of the drive shaft 24. The cross pin supports a drive plate or cam member 44 which has a pair of forwardly extending ears 46 to which the cross pin is secured and an upwardly extending section 48 which is provided with a pair of cam followers or rollers 50. The two rollers are supported on a pin 52 which extends through openings in a series of lugs 54 protruding rearwardly from the back side of the drive plate 44. This assembly is best shown in FIG. 3. The reaction plate 30 has a cam surface 56 machined on one section of its front face and rollers 50 are urged into engagement with the cam surface by means of springs 58 which are anchored to a pin 60 held by the reaction plate. The function of the cam and cam follower arrangement will be discussed in more detail below.

The drive plate 44 supports a swash plate 64 on three sets of bearings: a forward thrust bearing 66, a radial bearing 68 and a rear thrust bearing 70. The swash plate is provided with a series of sockets 72 receiving one end 73 of a connecting rod 74, the opposite end 75 being captured within a similar socket 76 on the underside of the pistons 80. The swash plate is anchored against rotation by means of a universal joint assembly including a pin 82 held in spherical bearing 83 which is carried at one end of arm 84. The opposite end of arm 84 is supported at 86 along an axis perpendicular to the axis of pin 82 by an extension 88 of the cylinder block assembly 90.

Figure 4:
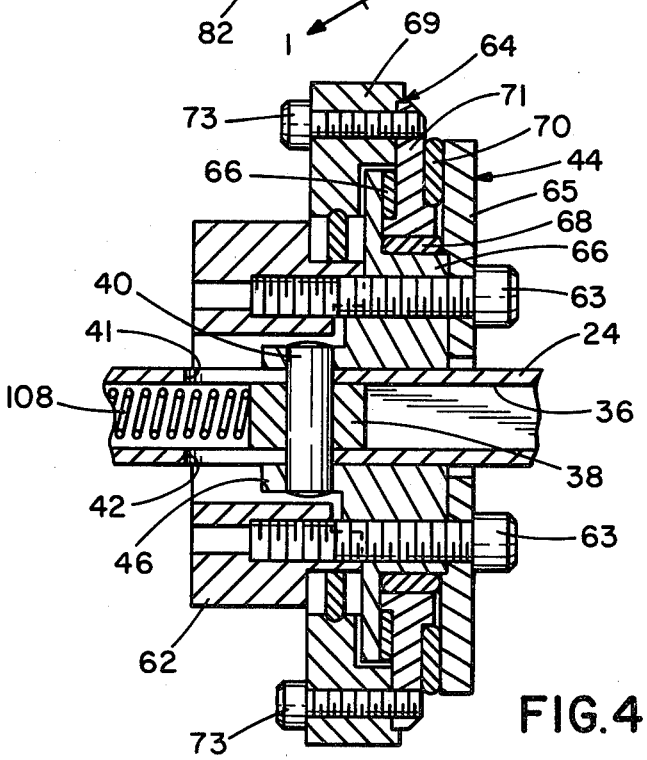
FIG. 4 is a partial cross-section view taken along the plane of line 4—4 of FIG. 1.

The forward portion of the drive plate 44 supports a balance ring 62 which is provided to center the rotational forces as closely as possible along the rotational axis of the drive shaft. As best shown in FIG. 4, the drive plate 44 and the balance ring 62 are secured by machine screws 63. Note that the drive plate is actually made up by the assembly of parts 65 and 67 also held together by screws 63; and the swash plate is formed of parts 69 and 71 secured by machine screws 73.

The cylinder block assembly 90 is fitted into the large end of the housing 10 and is provided with a series of cylinders 92 into which the pistons 80 are received for reciprocating motion. The central portion of the cylinder block is provided with a counterbore 94 for reception of the left hand end of drive shaft 24 and has a bore 96 connecting therewith for a lubricant flow control device 98 to be described in more detail below.

The valve plate 14 is seated on top of the large end of the casing and the upper surface of the cylinder block. It is provided with suction ports 100 and discharge ports 102 covered by appropriate valve members (not shown) as is understood by those skilled in the art. The head member 16 is formed with a discharge gas plenum 104 which communicates with the discharge ports 102 and a centrally located suction plenum 106 which connects with the gas working spaces 15 above the pistons in the cylinders through suction ports 100.

OPERATION

By controlling the pressure of fluid in crankcase 11, the position of swash plate 64 can be varied from full stroke to no-stroke and any desired intermediate position. Pressure control means (not shown) may take any number of forms; but for purposes of this disclosure, the system used in the aforementioned Roberts et al U.S. Pat. No. 3,861,829 may be used. It should be understood that the details of how pressure is controlled in crankcase 11 forms no part of the present invention.

The swash plate 64 and associated drive plate 44 are biased to the full stroke (maximum displacement from a vertical position) by means of a spring 108. The spring 108, under compression, pushes the slider 38 to the right (as viewed in FIG. 1). As pressure in the crankcase 11 is increased, the forces acting on the undersides of pistons 80 tend to push the swash plate to a more vertical position sliding the pivot point to the left as the rollers 50 follow the cam surface 56. This, of course, reduces stroke and capacity.

The lubrication of the compressor is accomplished by a flow circuit under control of the flow control device 98. Oil, separated from the discharge gas collects in a sump section 110 in head 16. Since the oil is under discharge pressure, it flows through passage 112 to a passage 114 in the center of the head and valve plate. Flow control device 98 is made up of two elements: non-rotating element 116 having angled passage 118 and rotating element 120 having L-shaped passage 122. When the two passages 118 and 122 communicate with each other during each revolution of the drive shaft, a small quantity of oil flows into the bore 36 for further distribution to various moving parts of the compressor. Spring 124 holds the non-rotating element 116 against rotating element 120.

While this invention has been described in connection with a certain specific embodiment thereof, it is to be understood that this is by way of illustration and not by way of limitation; and the scope of the appended claims should be construed as broadly as the prior art will permit.

What is claimed is:

1. A compressor comprising: means defining a plurality of gas working spaces each having a piston cooperating with suction and discharge ports to compress a compressible fluid therein; a drive shaft; a cam mechanism driven by said drive shaft; a swash plate driven by said cam mechanism in a nutating path about the drive shaft axis; means operably connected between said swash plate and the individual pistons to impart reciprocating drive to said pistons; means for supporting said swash plate and said cam mechanism for pivotal movement with respect to the axis of said drive shaft, the pivot point lying along said drive shaft axis; a cam follower associated with said cam mechanism, said cam follower including a roller, and an axially fixed cam surface cooperating with said roller, said roller engaging said axially fixed cam surface to shift the pivot point of said swash plate along said drive shaft axis to vary the stroke.

2. A compressor as defined in claim 1 including resilient means biasing said swash plate in the direction of maximum stroke.

3. A compressor as defined in claim 1 including a closed crankcase, the fluid pressure established in said crankcase being applied the underside of each said piston in opposition to the reaction pressure of gas being compressed in said gas working spaces.

4. A compressor as defined in claim 1 wherein said drive shaft is provided with an axial extending bore and a pair of opposed, elongated openings; a slider received in said bore; a cross-pin extending through said slider and said opposed openings, said cam mechanism being pivotally supported by the ends of said cross-pin.

5. A compressor as defined in claim 1 including resilient means urging said cam follower into contact with said cam surface.

6. A compressor as defined in claim 5 wherein said cam surface is contoured to maintain a fixed top-dead-center position of said pistons irrespective of stroke length.

* * * * *